US011201021B2

(12) United States Patent
Kuroki et al.

(10) Patent No.: US 11,201,021 B2
(45) **Date of Patent: *Dec. 14, 2021**

(54) SWITCH WITH GUIDE AND SEALANT

(71) Applicant: OMRON Corporation, Kyoto (JP)

(72) Inventors: Kenji Kuroki, Suita (JP); Yuya Kudo, Otsu (JP); Kenji Takahama, Okayama (JP)

(73) Assignee: OMRON Corporation, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/647,908

(22) PCT Filed: Oct. 12, 2018

(86) PCT No.: PCT/JP2018/038033

§ 371 (c)(1),
(2) Date: Mar. 17, 2020

(87) PCT Pub. No.: WO2019/078099

PCT Pub. Date: Apr. 25, 2019

(65) Prior Publication Data

US 2020/0219681 A1 Jul. 9, 2020

(30) Foreign Application Priority Data

Oct. 20, 2017 (JP) ..... JP2017-203842
Dec. 4, 2017 (JP) ..... JP2017-232315

(51) Int. Cl.
*H01H 13/14* (2006.01)
*H01H 13/06* (2006.01)
(Continued)

(52) U.S. Cl.
CPC ..... *H01H 13/14* (2013.01); *H01H 13/063* (2013.01); *H01H 13/10* (2013.01);
(Continued)

(58) Field of Classification Search
CPC ..... H01H 13/14; H01H 21/08; H01H 21/22; H01H 21/36; H01H 13/063; H01H 13/10;
(Continued)

(56) References Cited

U.S. PATENT DOCUMENTS 3,222,467 A * 12/1965 Meyer ..... H01H 13/063 200/16 D
3,764,762 A * 10/1973 Roeser ..... H01H 13/12 200/521
(Continued)

FOREIGN PATENT DOCUMENTS

CN 201590359 U 9/2010
DE 4208088 C1 * 4/1993 ..... H01H 13/063
(Continued)

OTHER PUBLICATIONS

English translation of the International Search Report("ISR") of PCT/JP2018/038033 dated Dec. 25, 2018.
(Continued)

*Primary Examiner* — Lheiren Mae A Caroc
(74) *Attorney, Agent, or Firm* — Metrolex IP Law Group, PLLC

(57) ABSTRACT

A switch includes a housing, a movable member reciprocable in the movement direction relative to the housing and including an operation part located at an end of the movable member outside the housing, a guide that guides the movable member in the movement direction, and a sealant sealing a gap between the movable member and the housing inside the compartment.

2 Claims, 10 Drawing Sheets

(51) Int. Cl.

| | |
|---|---|
| ***H01H 13/10*** | (2006.01) |
| ***H01H 21/08*** | (2006.01) |
| ***H01H 21/22*** | (2006.01) |
| ***H01H 21/36*** | (2006.01) |

(52) U.S. Cl.
CPC ..... *H01H 21/08* (2013.01); *H01H 21/22* (2013.01); *H01H 21/36* (2013.01); *H01H 2221/058* (2013.01); *H01H 2221/088* (2013.01)

(58) Field of Classification Search
CPC ..... H01H 2221/088; H01H 2221/058; H01H 2221/026; H01H 13/06; H01H 21/085; H01H 9/04; H01H 25/04
USPC ..... 200/302.1–302.3
See application file for complete search history.

(56) References Cited

U.S. PATENT DOCUMENTS

| | | | | |
|---|---|---|---|---|
| 6,274,826 | B1 * | 8/2001 | Serizawa | H01H 23/003 200/1 B |
| 2020/0243281 | A1 * | 7/2020 | Kuroki | H01H 21/22 |

FOREIGN PATENT DOCUMENTS

| | | | |
|---|---|---|---|
| JP | H4-085537 | U | 7/1992 |
| JP | 2001-229767 | A | 8/2001 |
| JP | 2006-331810 | A | 12/2006 |
| JP | 2007-35333 | A | 2/2007 |
| JP | 2009-158305 | A | 7/2009 |
| JP | 2012-3872 | A | 1/2012 |

OTHER PUBLICATIONS

Written Opinion("WO") of PCT/JP2018/038033 dated Dec. 25, 2018.
Office Action (CNOA) dated Jul. 5, 2021 in a counterpart Chinese patent application.

* cited by examiner

SWITCH WITH GUIDE AND SEALANT

FIELD

The present disclosure relates to a switch.

BACKGROUND

Patent Literature 1 describes a switch device including a housing with a compartment, and an operation lever and a coil spring accommodated in the compartment. The operation lever attached to the housing in the switch device partially protrudes from the compartment, and is urged by the coil spring in the direction in which the operation lever protrudes from the compartment.

CITATION LIST

Patent Literature

Patent Literature 1: Japanese Unexamined Patent Application Publication No. 2001-229767

SUMMARY

Technical Problem

In the switch device, the operation lever is a substantially triangular flat plate having one vertex exposed from the compartment and two vertexes accommodated in the compartment, and is attached to the housing in a manner rotatable about one of the two vertexes located inside the compartment among the three vertexes of the substantially triangular flat plate in two directions facing each other. The switch device can have a gap variously spaced between the operation lever and the housing in accordance with the position of the operation lever and is thus difficult to seal with, for example, a sealant, and may not have high sealing performance.

One or more aspects of the present disclosure are directed to a switch with high sealing performance and operable in multiple directions.

Solution to Problem

A switch according to one aspect of the disclosure includes a housing having an operation surface with an operation hole and an internal compartment communicating with outside through the operation hole, a movable member accommodated in the compartment and extending in a movement direction orthogonal to the operation surface from the compartment to outside the housing through the operation hole, including an operation part located at an end of the movable member outside the housing, and reciprocable in the movement direction relative to the housing, a guide that guides the movable member in the movement direction, and a sealant sealing a gap between the movable member and the housing inside the compartment. The operation part has a plurality of slopes extending linearly from the operation surface toward a distal end of the movable member outside the housing, and sloping toward a central axis extending in the movement direction of the movable member away from the operation surface.

Advantageous Effects

The switch according to the above aspect includes the movable member reciprocable in the movement direction relative to the housing, the guide for guiding the movable member in the movement direction, and the sealant sealing the gap between the movable member and the housing inside the compartment. The movable member includes the operation part having the multiple slopes extending linearly from the operation surface toward the distal end of the movable member outside the housing, and sloping toward the central axis of the movable member away from the operation surface. The switch with this structure has higher sealing performance and is operable in multiple directions.

DETAILED DESCRIPTION

Embodiments of the present disclosure will now be described with reference to the accompanying drawings. The terms indicating specific directions or positions (e.g., up, down, right, and left) used herein as appropriate are for easy understanding of the present disclosure with reference to the drawings, and do not limit the technical scope of the present disclosure. The embodiments described below are mere examples and do not limit the scope of the present disclosure and its applications or use. The drawings are only schematic and may not be drawn to scale relative to the actual size of each component.

First Embodiment

Figure 1:
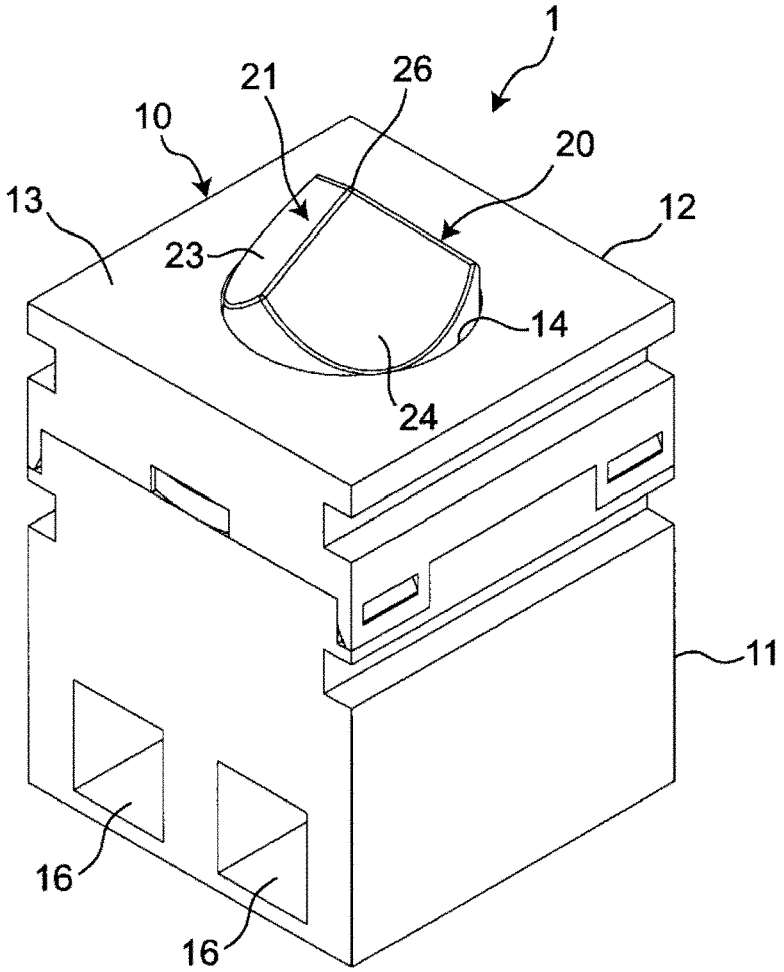
FIG. 1 is a perspective view of a switch according to a first embodiment of the present disclosure.
Figure 2:
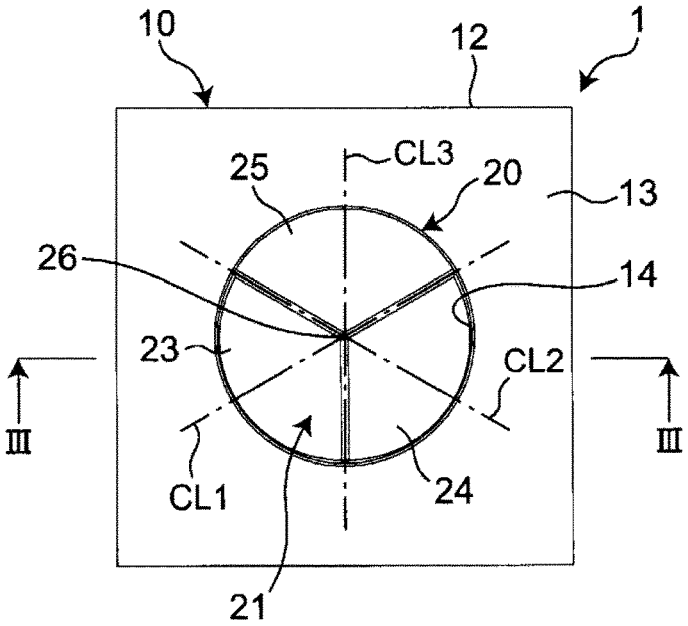
FIG. 2 is a plan view of the switch in FIG. 1.

As shown in FIGS. 1 and 2, a switch 1 according to a first embodiment of the present disclosure includes a housing 10 and a movable member 20 accommodated in the housing 10.

Figure 3:
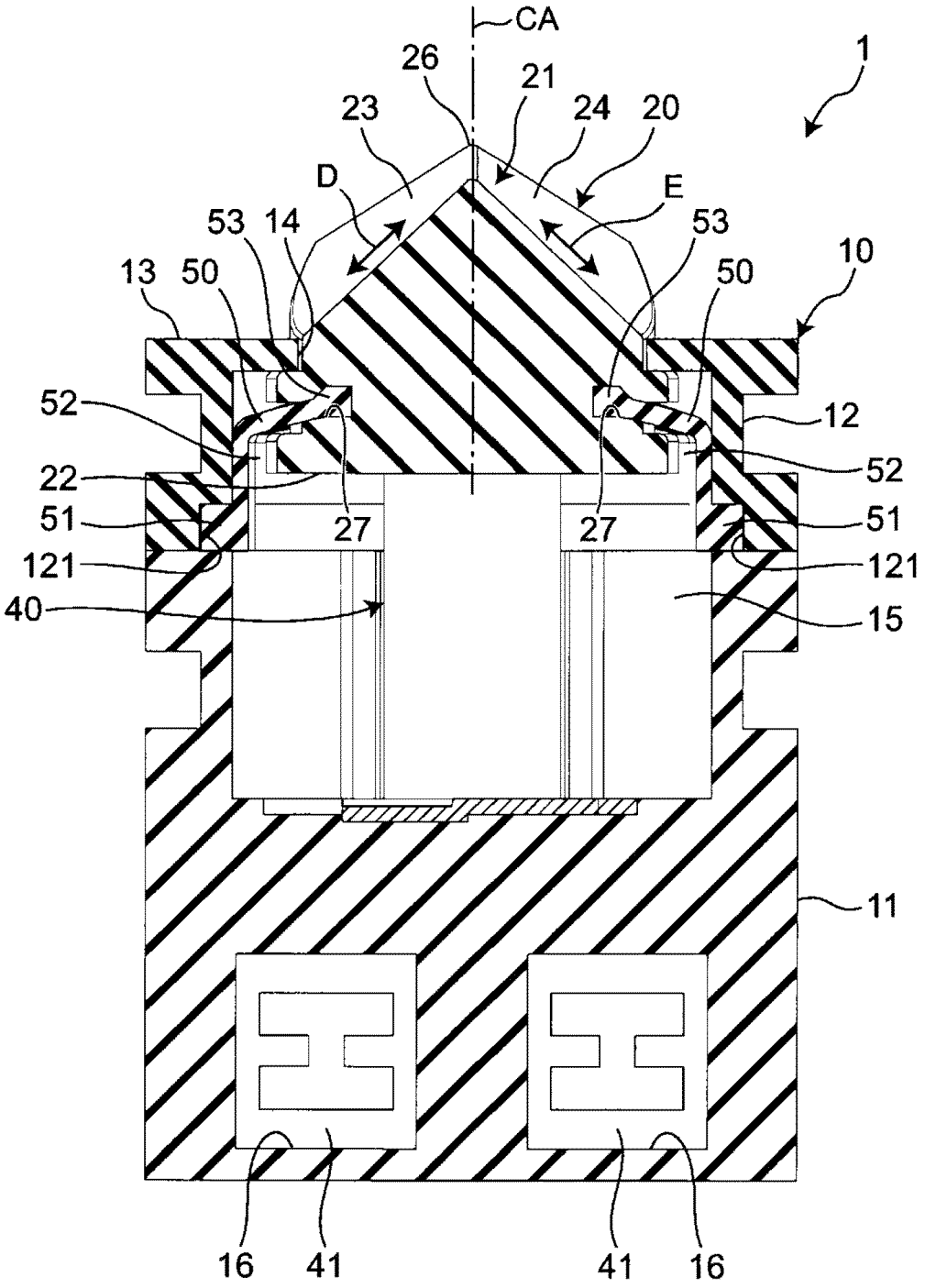
FIG. 3 is a cross-sectional view taken along line III-III in FIG. 2.

The housing 10 has an operation surface 13 with an operation hole 14 and further has an internal compartment 15 (shown in FIG. 3). The movable member 20 accommodated in the compartment 15 in the housing 10 is partially exposed outside the housing 10 through the operation hole 14. The movable member 20 is located in a manner reciprocable relative to the housing 10 in a movement direction intersecting with (e.g., orthogonal to) the operation surface 13 through the operation hole 14. The reciprocation of the movable member 20 activates or deactivates a contact mechanism 40 (shown in FIG. 3) inside the housing 10 to turn on or off the switch 1.

Figure 4:
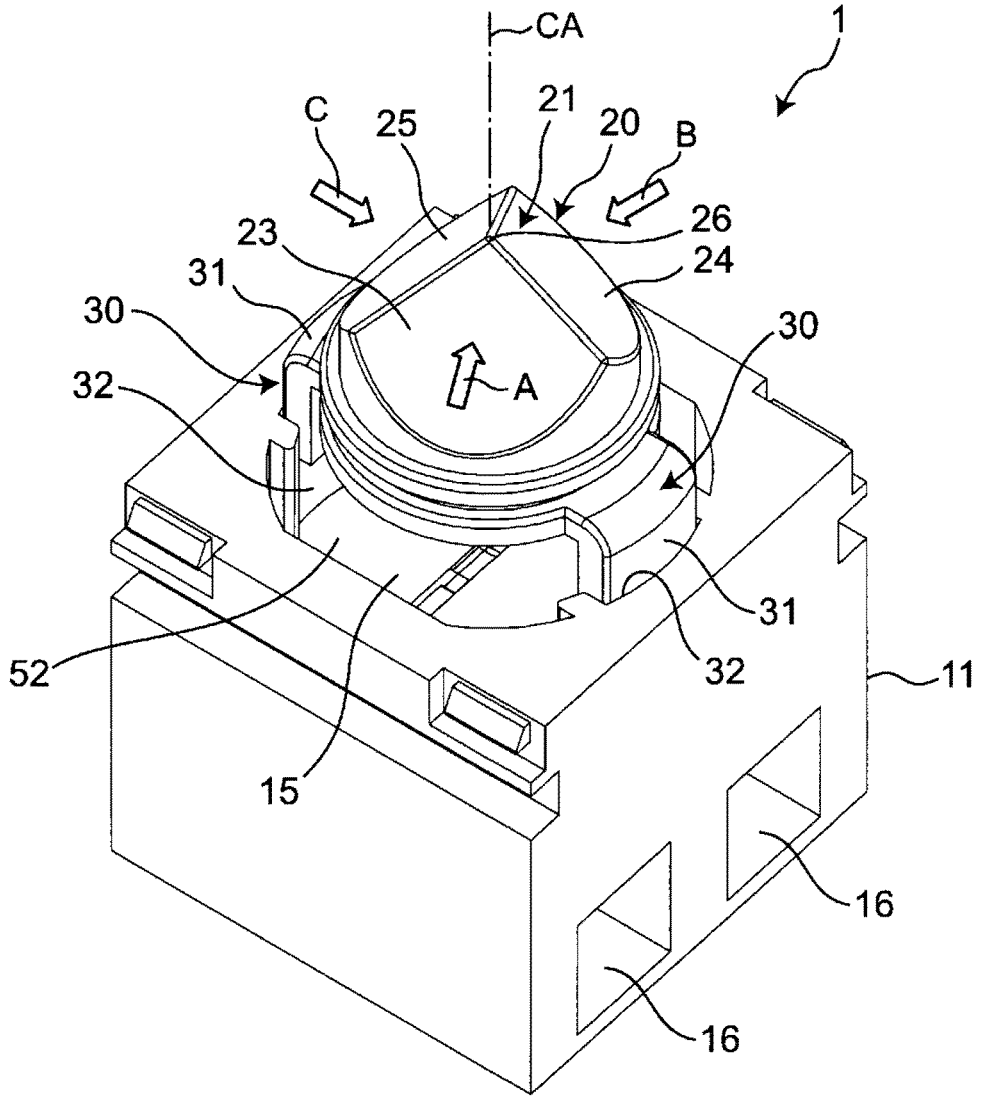
FIG. 4 is a perspective view of the switch in FIG. 1 excluding a cover and a sealant.

As shown in FIG. 4, the switch 1 includes guides 30 for guiding the movable member 20 in the movement direction. The guides 30 are located inside the compartment 15. In FIG. 4, a cover 12, the contact mechanism 40, and a sealant 50 (described later) in the housing 10 are not shown.

The components of the switch 1 will now be described.

As shown in FIG. 1, the housing 10 includes a case 11, which is a substantially rectangular box, and the cover 12. As shown in FIG. 3, the housing 10 has the internal compartment 15 defined by the case 11 and the cover 12.

As shown in FIG. 1, the case 11 has two through-holes 16 extending through a pair of facing side surfaces below the compartment 15. As shown in FIG. 3, the through-holes 16 partially receive a pair of terminals 41 (described later) to allow connection of, for example, a conductive portion of a wire (not shown) placed in each through-hole 16 to the corresponding terminal 41.

As shown in FIGS. 1 and 2, the cover 12 has an upper surface serving as the operation surface 13, and the circular operation hole 14 at the substantial center of the operation surface 13. The compartment 15 inside the housing 10 communicates with the outside of the housing 10 through the operation hole 14.

As shown in FIG. 3, the cover 12 has a sealing cutout 121 (an example of a second sealing connector) in an end facing the case 11. The sealing cutout 121 extends along the entire inner peripheral surface defining the compartment 15 of the cover 12 about the axis in the movement direction, and receives a flange 51 (described later) on the sealant 50 along the entire periphery.

As shown in FIG. 3, the movable member 20 extends from inside the compartment 15 to outside the housing 10 through the operation hole 14 in the movement direction (specifically, in the vertical direction in FIG. 3). The movable member 20 includes, at its end outside the housing 10, an operation part 21 exposed outside the housing 10. The movable member 20 also has, at its end adjacent to the compartment 15, a working surface 22 facing and being partially in contact with the contact mechanism 40.

The movable member 20 has, on an end adjacent to the working surface 22, a seal groove 27 (an example of a first sealing connector) extending along the entire periphery about a central axis CA extending in the movement direction of the movable member 20 (hereafter, about the axis in the movement direction.) The seal groove 27 receives an opening edge 53 (described later) of the sealant 50 along the entire periphery.

The contact mechanism 40 is electrically connected to the pair of terminals 41 located electrically independent of each other, and urges the movable member 20 toward outside the housing 10 in the movement direction.

As shown in FIGS. 1 and 2, the operation part 21 is a substantially triangular pyramid, and has multiple (three in the first embodiment) slopes 23, 24, and 25 each serving as a pyramidal face. The slopes 23, 24, and 25 extend linearly from the operation surface 13 toward a distal end 26 of the movable member 20 outside the housing 10, slope toward a central axis CA extending in the movement direction of the movable member 20 away from the operation surface 13, and slope in directions intersecting with one another as viewed in the movement direction about the central axis CA. The sloping directions refer to the direction along the slopes 23, 24, and 25. Examples are shown in FIG. 3. In FIG. 3, arrow D indicates an example sloping direction of the slope 23, and arrow E indicates another example sloping direction of the slope 24.

More specifically, the slopes 23, 24, and 25 are sectors each having a central angle of about 120 degrees. The three slopes 23, 24, and 25 define the outer surface (pyramidal faces) of the operation part 21. When the slope 23 is a first slope 23 and the slopes 24 and 25 adjacent to the first slope 23 about the central axis CA are a second slope 24 and a third slope 25, the second slope 24 and the third slope 25 have their center lines CL2 and CL3 located each at an angle of about 120 degrees about the central axis CA with respect to a center line CL1 of the first slope 23. Thus, the second slope 24 and the third slope 25 are adjacent to the first slope 23 about the central axis CA, and are located within an angle of less than 180 degrees (120 degrees in the first embodiment) about the central axis CA with respect to the first slope 23.

As shown in FIG. 4, the guide 30 is located on at least one side of the movable member 20 in an operational direction (specifically, the direction intersecting with the central axis CA of the movable member 20) intersecting with the movement direction of the movable member 20 (specifically, the direction along the central axis CA).

More specifically, each guide 30 has a protrusion 31 on one of the housing 10 and the movable member 20 and a groove 32 on the other of the housing 10 and the movable member 20. The protrusion 31 protrudes in the operational direction and is elongated in the movement direction. The groove 32 extends in the movement direction to receive the protrusion 31 and guide the received protrusion 31 in the movement direction.

In the first embodiment, arrows A to C in FIG. 4 indicate the operational directions, and the guides 30 are located on both sides of the movable member 20 in the operational directions A to C with respect to the movable member 20. The protrusions 31 are arranged symmetrical to each other with respect to the central axis CA on the radially outer surface of the movable member 20 with respect to the central axis CA. The grooves 32 are arranged symmetrical to each other with respect to the central axis CA on the inner peripheral surface of the housing 10 in the operational direction defining the compartment 15.

As shown in FIG. 3, the switch 1 further includes the sealant 50 sealing a gap 52 between the movable member 20 and the housing 10 inside the compartment 15.

The sealant 50 is tubular and has openings at its two ends in the movement direction. The sealant 50 is formed from an insulating resin such as rubber. The upper opening edge 53, which is a first opening edge of the sealant 50, extends along the entire periphery of the seal groove 27 on the movable member 20, and covers the entire outer periphery of the movable member 20 between the operation part 21 and the working surface 22 while being press-fitted against the movable member 20. More specifically, the upper opening edge 53 of the sealant 50 is received and sealed in the seal groove 27 along the entire periphery of the movable member 20 about the axis in the movement direction. The upper end of the sealant 50 thus reciprocates in the movement direction as the movable member 20 reciprocates. The sealant 50 has, at a second opening edge, the flange 51 protruding radially outward with respect to the central axis CA, and extending along the entire periphery about the central axis CA. The flange 51 has the entire periphery received in the sealing cutout 121 on the cover 12, and is held between the case 11 and the cover 12 of the housing 10. The flange 51 on the sealant 50 is received and sealed in the sealing cutout 121 along the entire inner peripheral surface defining the compartment 15 of the cover 12 about the axis in the movement direction.

The operation of the switch 1 will now be described.

For example, when an external force is applied to the first slope 23 of the operation part 21 in the operational direction A shown in FIG. 4, the external force presses the movable member 20 in the operational direction A and toward the inside of the compartment 15.

Thus, when an external force is applied to the operation part 21 of the movable member 20 in the operational direction, the movable member 20 is depressed toward the compartment 15 against the urging force from the contact mechanism 40, and is guided by the guides 30 from outside the housing 10 into the compartment 15 along the central axis CA (in the movement direction). The pair of terminals 41 are thus electrically connected with each other, and the switch 1, which has been off, is turned on.

When the external force applied to the operation part 21 is released, the movable member 20 is urged by the contact mechanism 40 from the compartment 15 in the housing 10 toward outside the housing 10, and is guided by the guides 30 from the compartment 15 toward outside the housing 10 in the movement direction. The pair of terminals 41 are thus electrically disconnected from each other, and the switch 1, which has been on, is turned off.

The switch 1 is operated when an external force is applied to the first slope 23 of the operation part 21 in the operational direction A shown in FIG. 4 in the above embodiment. However, the switch 1 is operable in the same manner when an external force is applied to the second slope 24 of the operation part 21 in the operational direction B or to the third slope 25 in the operational direction C shown in FIG. 4. The switch 1 can thus be turned on or off by an operation performed in multiple directions.

In the switch 1 according to the first embodiment, the movable member 20 includes the operation part 21 located at the end outside the housing 10, and is reciprocable in the movement direction relative to the housing 10. The operation part 21 has the multiple slopes 23, 24, and 25 sloping away from the central axis CA of the movable member 20 toward the operation surface 13 and sloping in the directions intersecting with one another as viewed in the movement direction. The multiple slopes 23, 24, and 25 allow the movable member 20 to be operable in multiple directions about the central axis CA. The switch 1 thus has a lower likelihood of the operational direction being limited.

The slopes 23, 24, and 25 extend linearly from the operation surface 13 toward the distal end 26 of the movable member 20 outside the housing 10. This structure allows the slope angles of the slopes 23, 24, and 25 with respect to the operation surface 13 to be adjusted more easily than, for example, the slope angle of a movable member having a peripheral surface standing upward from the operation surface 13 toward outside the housing 10 in a direction perpendicular to the operation surface 13. The external force applied in the operational direction is thus easily transmitted in the movement direction. This improves the operability of the switch 1.

The slopes 23, 24, and 25 may have a slope angle of 1 to 60 degrees with respect to the operation surface 13. When the slope angle is less than one degree, an external force is difficult to apply to the slopes 23, 24, and 25 in the operational direction. When the slope angle is more than 60 degrees, an external force applied in the operational direction is difficult to transmit in the movement direction. When, for example, extending outward from the housing 10 curvedly rather than linearly, the slopes 23, 24, and 25 slope at more than 60 degrees near the operation surface 13. This may lower the operability of the switch 1.

The multiple slopes include the first slope 23 and the second slope 24. The second slope 24 is adjacent to the first slope 23 about the central axis CA and is located within an angle of less than 180 degrees about the central axis CA with respect to the first slope 23. The movable member 20 is more reliably operable in multiple three-dimensional directions. The switch 1 thus has a lower likelihood of the operational direction being limited.

Each guide 30 has the protrusion 31 located on one of the housing 10 and the movable member 20, protruding in the operational direction, and elongated in the movement direction and the groove 32 located on the other of the housing 10 and the movable member 20, extending in the movement direction, receiving the protrusion 31, and guiding the received protrusion 31 in the movement direction. The guides 30 thus guide the movable member 20 in the movement direction more reliably. The switch 1 thus has higher operability.

The switch 1 further includes the sealant 50 sealing the gap 52 between the movable member 20 and the housing 10 inside the compartment 15. The sealant 50 can protect the contact mechanism 40 from fluid such as water entering the compartment 15 through the operation hole 14 in the operation surface 13.

The multiple slopes are not limited to the three slopes 23, 24, and 25 of the operation part 21 in the switch 1, and may simply slope toward the central axis CA of the movable member 20 away from the operation surface 13 and slope in the directions intersecting with one another as viewed in the movement direction.

Figure 5:
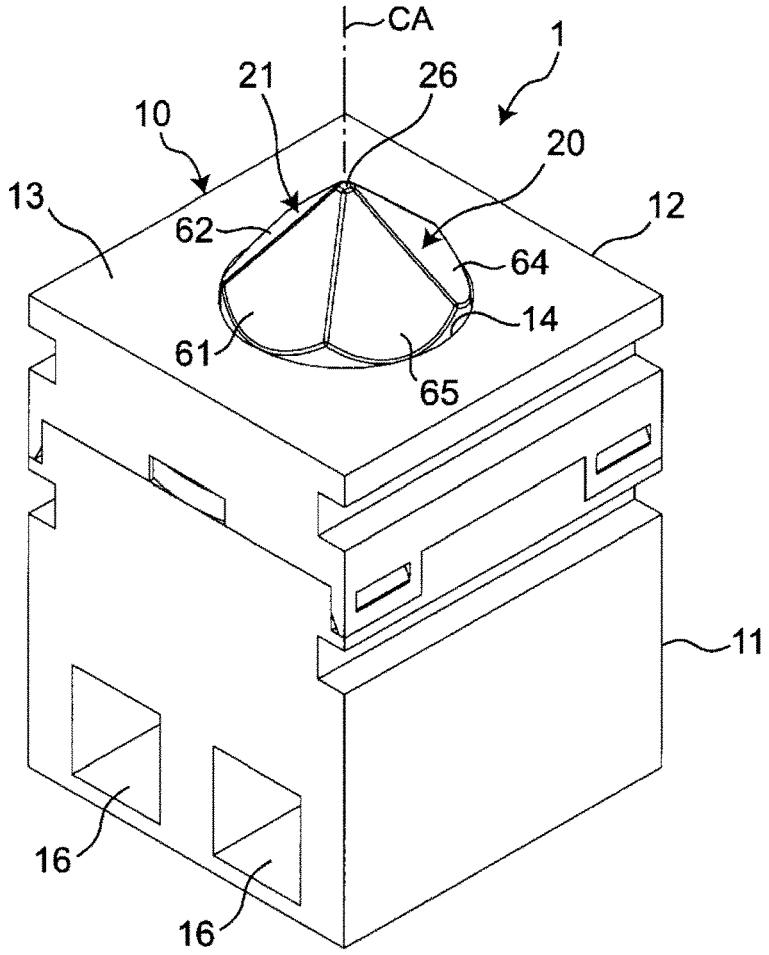
FIG. 5 is a perspective view of a switch according to a first modification of the switch in FIG. 1.
Figure 6:
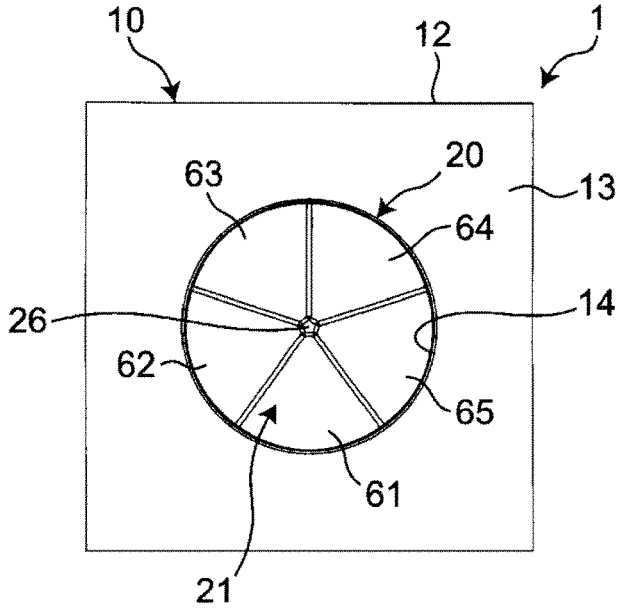
FIG. 6 is a plan view of the switch in FIG. 5.

As shown in FIGS. 5 and 6, for example, the operation part 21 may have five slopes 61, 62, 63, 64, and 65. In this case, the slopes 61, 62, 63, 64, and 65 are sectors each having a central angle of about 72 degrees. The five slopes 61, 62, 63, 64, and 65 define the outer surface of the operation part 21. Slopes (e.g., the slopes 62 and 65) adjacent to one slope (e.g., the slope 61) may be located within an angle of less than 180 degrees about the central axis CA with respect to that slope.

Figure 7:
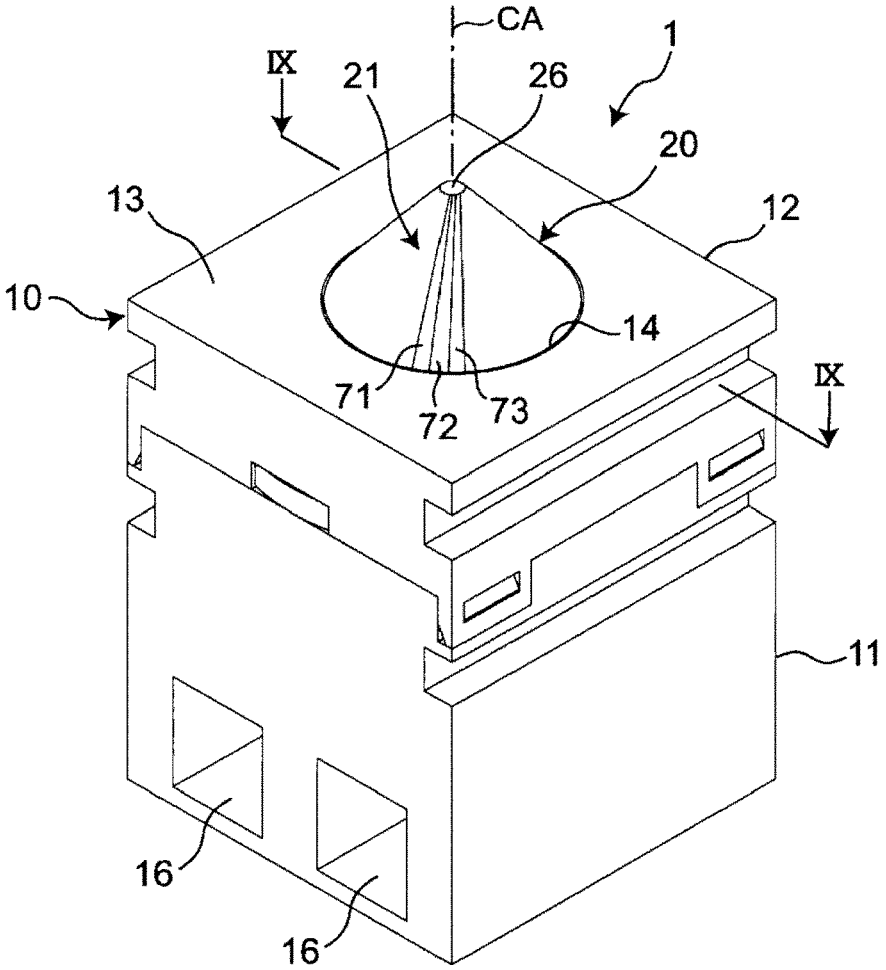
FIG. 7 is a perspective view of a switch according to a second modification of the switch in FIG. 1.
Figure 8:
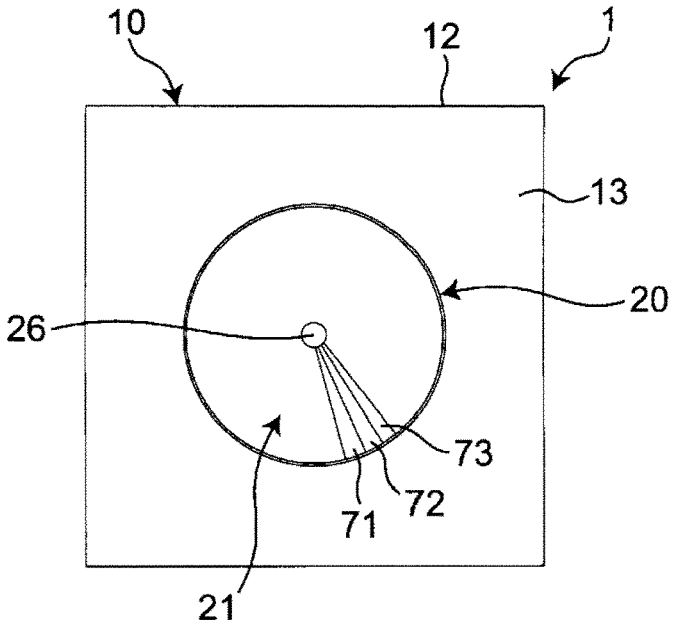
FIG. 8 is a plan view of the switch in FIG. 7.

As shown in FIGS. 7 and 8, for example, the operation part 21 may have more slopes (e.g., slopes 71, 72, and 73 shown in FIG. 7). In this case, the slopes 71, 72, and 73 are sectors each having a central angle of about 360/N degrees, where N is the total number of slopes. The N slopes define the outer surface of the operation part 21. Slopes (e.g., the slopes 71 and 73) adjacent to one slope (e.g., the slope 72) may be located within an angle of less than 180 degrees about the central axis CA with respect to that slope.

The operation part 21 may be at least a pyramid. Thus, the operation part 21 may be a cone having the multiple slopes 23, 24, and 25 as in the switch 1, or may be a pyramid having multiple pyramidal faces exposed outside the housing 10 and each serving as a slope. The shape of the operation part 21 may be changed as appropriate in accordance with, for example, the design of the switch 1. This increases the design freedom of the switch 1.

The slopes 23, 24, and 25 of the operation part 21 may not be sectors, and may be triangles. More specifically, the operation part 21 may be circular when viewed in the movement direction, or may be polygonal (e.g., triangular in the switch 1 in FIGS. 1 and 2 and pentagonal in the switch 1 in FIGS. 5 and 6) in accordance with the number of slopes.

Figure 9:
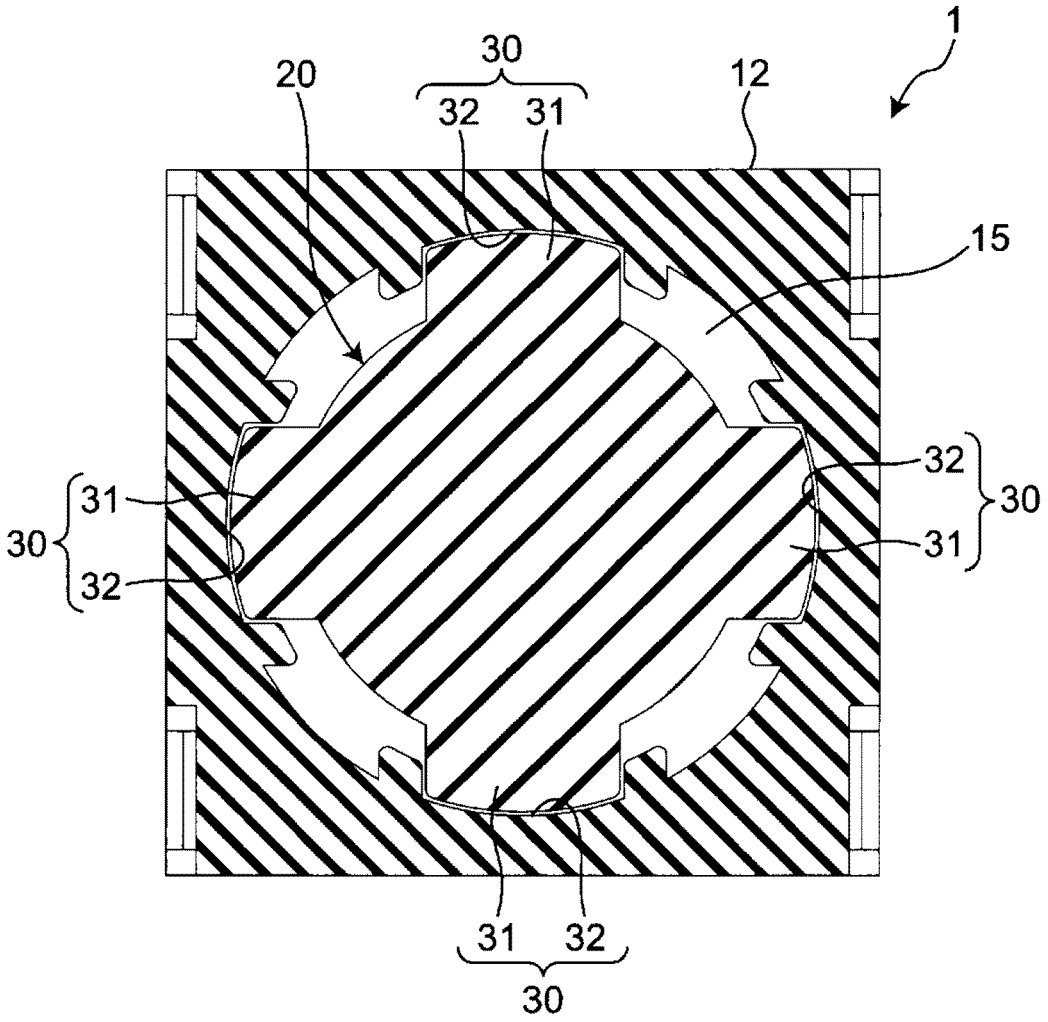
FIG. 9 is a cross-sectional view taken along line IX-IX in FIG. 7.
Figure 10:
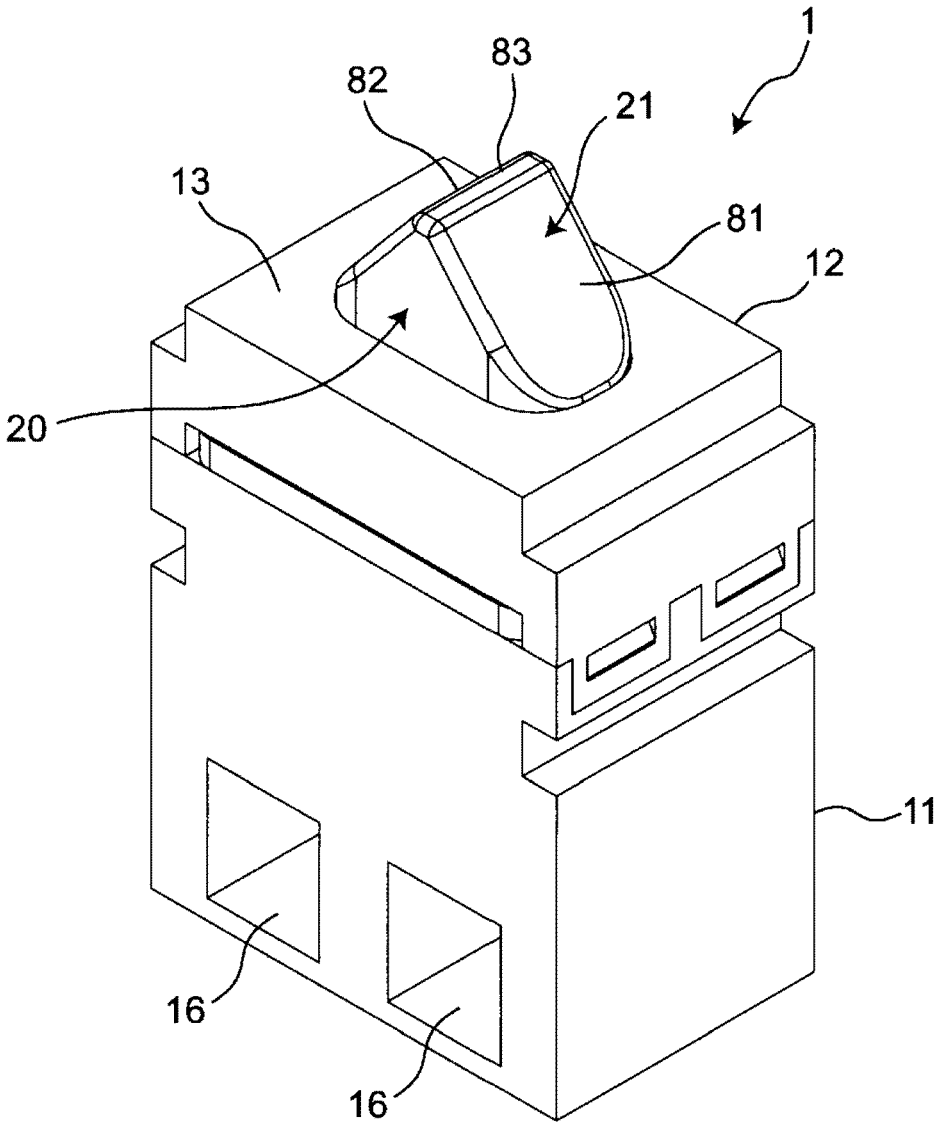
FIG. 10 is a perspective view of a switch according to a second embodiment of the present disclosure.

The guide 30 may be located on at least one side of the movable member 20 in the operational direction with respect to the movable member 20, rather than the two guides 30 on the two sides of the movable member 20 in the operational direction as in the first embodiment. Three or more guides 30 may be provided. FIG. 9 shows one example switch 1 including four guides 30.

The contact mechanism 40 may have any contact structure (e.g., sliding contact and butting contact).

The sealant 50, which is tubular and has openings at its two ends in the movement direction, may not be formed from an insulating resin such as rubber, and may be, for example, an O-ring or an X-ring. More specifically, the sealant 50 may be any sealant that seals the gap 52 between the movable member 20 and the housing 10 inside the compartment 15.

Second Embodiment

As shown in FIGS. 10 to 13, a switch 1 according to a second embodiment of the present disclosure differs from the switch 1 according to the first embodiment in that a movable member 20 is substantially rectangular as viewed in a movement direction, and includes an operation part 21 having two slopes 81 and 82 extending in directions opposite to each other in the length direction from a middle portion 83 of the movable member 20 in the length direction as viewed in the movement direction.

The components in the switch 1 according to the second embodiment that are the same as those in the first embodiment are given the same reference numerals, and will not be described.

Figure 11:
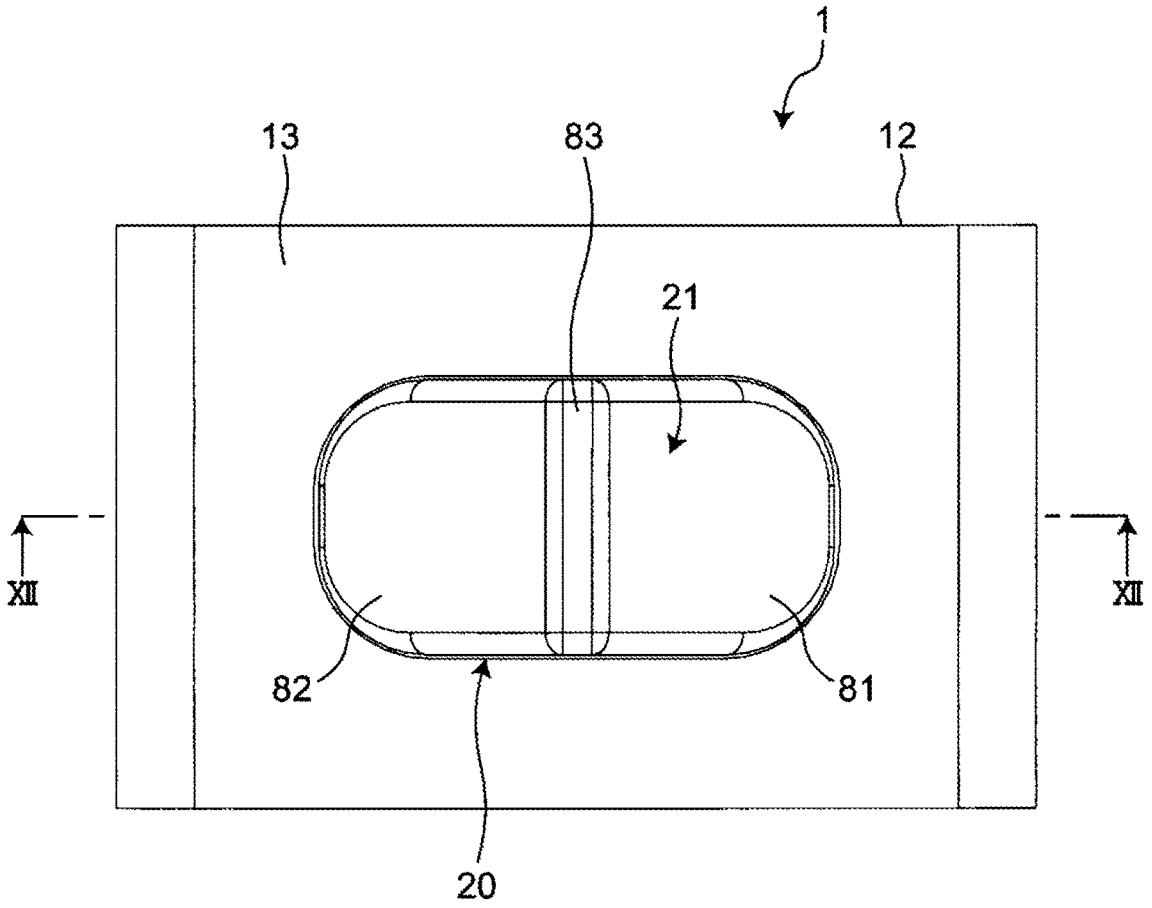
FIG. 11 is a plan view of the switch in FIG. 10.
Figure 12:
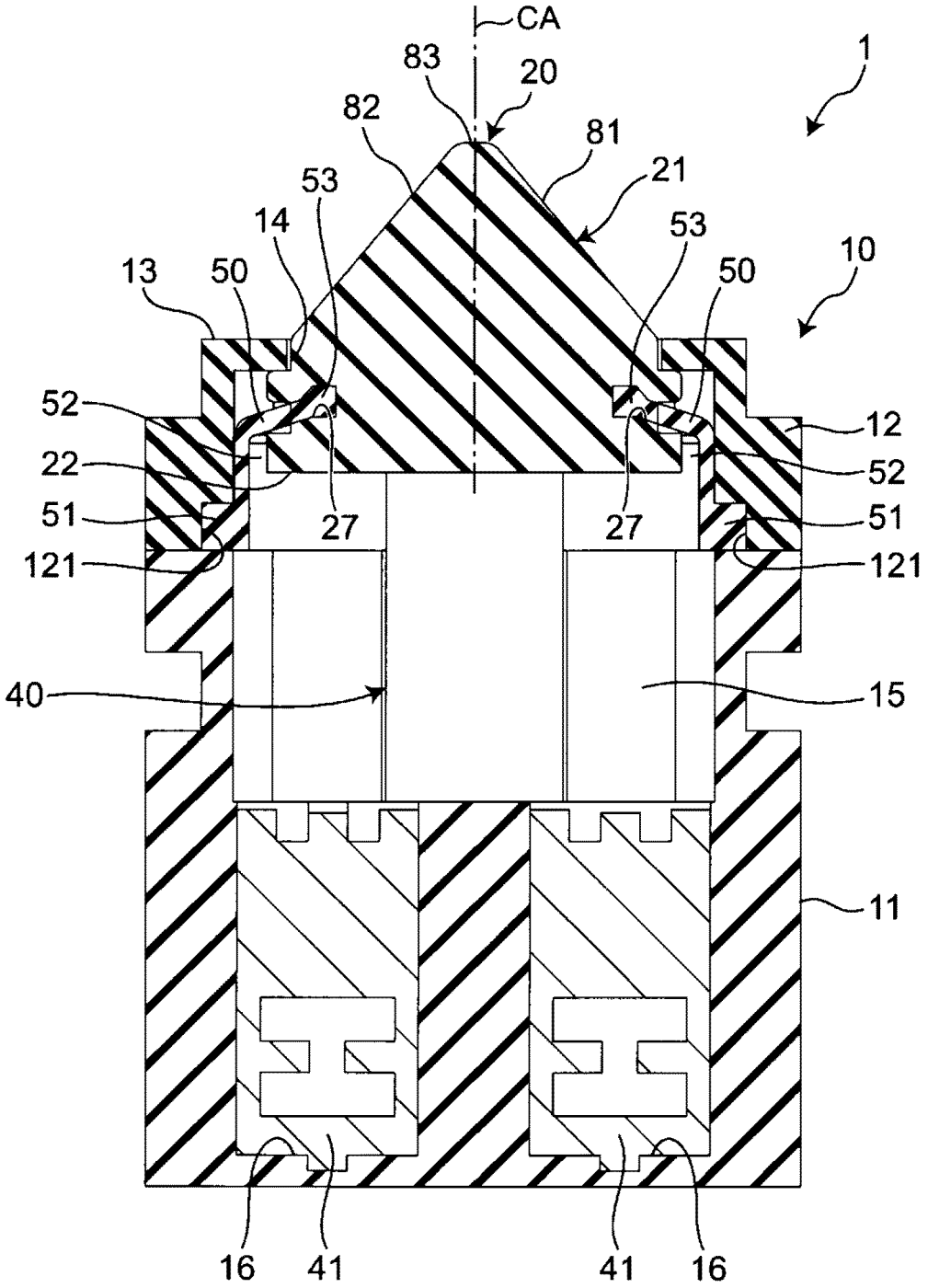
FIG. 12 is a cross-sectional view taken along line XII-XII in FIG. 11.

The movable member 20 in the switch 1 according to the second embodiment is rectangular as viewed in the movement direction as shown in FIG. 11, and extends from inside a compartment 15 to outside a housing 10 through an operation hole 14 in the movement direction orthogonal to an operation surface 13 (specifically, the extending direction of a central axis CA of the movable member 20) as shown in FIG. 12.

The operation part 21 is substantially rectangular as viewed in the movement direction as shown in FIG. 11, and is substantially isosceles triangular as viewed in the width direction of the operation part 21 viewed in the movement direction as shown in FIG. 12. The slopes 81 and 82 each define an oblique side of the substantial triangle. More specifically, the slopes 81 and 82 extend linearly from the operation surface 13 toward the middle portion 83 (specifically, a distal end of the movable member 20 outside the housing 10), and slope toward the central axis CA away from the operation surface 13.

Figure 13:
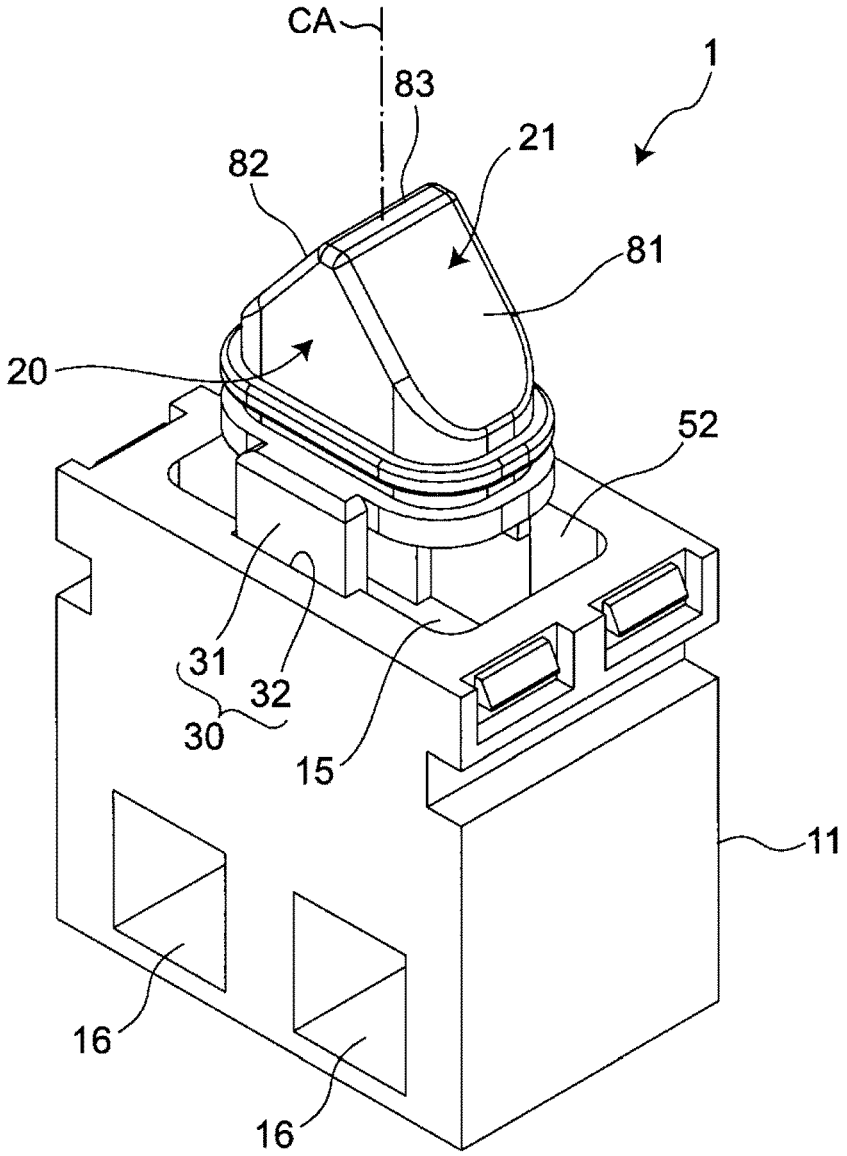
FIG. 13 is a perspective view of the switch in FIG. 10 excluding a cover and a sealant.

As shown in FIG. 13, guides 30 are located on both sides of the movable member 20 in an operational direction (specifically, the length direction of the movable member 20 as viewed in the movement direction) orthogonal to the movement direction. The guides 30 allow the movable member 20 to reciprocate linearly in the movement direction orthogonal to the operation surface 13. Similarly to the switch 1 according to the first embodiment, the switch 1 according to the second embodiment has protrusions 31 on the movable member 20 and grooves 32 on the housing 10.

The switch 1 according to the second embodiment includes the movable member 20 reciprocable in the movement direction relative to the housing 10, the guides 30 for guiding the movable member 20 in the movement direction, and a sealant 50 sealing a gap 52 between the movable member 20 and the housing 10 inside the compartment 15. The movable member 20 includes the operation part 21 having the multiple slopes 81 and 82 extending linearly from the operation surface 13 toward the distal end of the movable member 20 outside the housing 10, and sloping toward the central axis CA of the movable member 20 away from the operation surface 13. The movable member 20 reciprocates linearly in a direction orthogonal to the operation surface 13 along the guides 30. This creates the gap 52 substantially uniformly spaced between the housing 10 and the movable member 20, which can be sealed easily with the sealant 50. The multiple slopes 81 and 82 of the operation part 21 allow the movable member 20 to be operable in multiple directions. The switch 1 according to the second embodiment has higher sealing performance, and is operable in multiple directions.

The sealant 50 is tubular and has openings at its two ends in the movement direction. The movable member 20 has a seal groove 27, which is an example of a first sealing connector. The housing 10 has a sealing cutout 121, which is an example of a second sealing connector. The seal groove 27 extends along the entire periphery of the movable member 20 about the axis in the movement direction, and receives and seals the entire periphery of the first opening edge 53 of the sealant 50. The sealing cutout 121 extends along the entire inner peripheral surface defining the compartment 15 of the housing 10 about the axis in the movement direction, and receives and seals the entire periphery of a second opening edge 51 of the sealant 50. This structure allows the gap 52 between the housing 10 and the movable member 20 to be sealed more reliably.

The movable member 20 is rectangular as viewed in the movement direction, and the guides 30 are located on both sides of the movable member 20 in the width direction as viewed in the movement direction. The guides 30 can have a larger proportion on the outer surface of the movable member 20, and thus can guide the movable member 20 in the movement direction more reliably and stably. The switch 1 thus has higher operability. The switch 1 can be thinner in the width direction of the movable member 20 as viewed in the movement direction.

The slopes 81 and 82 may not extend in the directions opposite to each other in the length direction from the middle portion 83 of the movable member 20 in the length direction as viewed in the movement direction. The slopes 81 and 82 may simply extend linearly from the operation surface 13 toward the distal end of the movable member 20 outside the housing 10, and slope toward the central axis CA of the movable member 20 away from the operation surface 13. For example, the slopes 81 and 82 may slope in directions intersecting with each other as viewed in the movement direction as in the switch 1 according to the first embodiment.

The slopes may include multiple slopes, and are not limited to the two slopes 81 and 82.

The embodiments of the present disclosure are described above in detail with reference to the drawings. The embodiments may be modified in various forms described below. The components below are given reference numerals in one example.

A switch 1 according to a first aspect of the present disclosure includes a housing 10 having an operation surface 13 with an operation hole 14 and an internal compartment 15 communicating with outside through the operation hole 14, a movable member 20 accommodated in the compartment 15 and extending in a movement direction orthogonal to the operation surface 13 from the compartment 15 to outside the housing 10 through the operation hole 14, including an operation part 21 located at an end of the movable member 20 outside the housing 10, and reciprocable in the movement direction relative to the housing 10, a guide 30 that guides the movable member 20 in the movement direction, and a sealant 50 sealing a gap 52 between the movable member 20 and the housing 10 inside the compartment 15.

The operation part 21 has a plurality of slopes 81 and 82 extending linearly from the operation surface 13 toward a distal end of the movable member 20 outside the housing 10, and sloping away from a central axis CA extending in the movement direction of the movable member 20 toward the operation surface 13.

The switch 1 according to the first aspect includes the movable member 20 reciprocable in the movement direction relative to the housing 10, the guide 30 for guiding the movable member 20 in the movement direction, and the sealant 50 sealing the gap 52 between the movable member 20 and the housing 10 inside the compartment 15. The movable member 20 includes the operation part 21 having the plurality of slopes 81 and 82 extending linearly from the operation surface 13 toward the distal end of the movable member 20 outside the housing 10, and sloping toward the central axis CA of the movable member 20 away from the operation surface 13. The movable member 20 reciprocates linearly in a direction orthogonal to the operation surface 13 along the guide 30, creating the gap 52 substantially uniformly spaced between the housing 10 and the movable member 20 independently of the position of the movable member 20. The sealant 50 thus easily seals the gap 52 between the housing 10 and the movable member 20. The operation part 21 having the multiple slopes 81 and 82 allows the movable member 20 to be operable in multiple directions. The switch 1 according to the first aspect thus has higher sealing performance, and is operable in multiple directions.

In a switch 1 according to a second aspect of the present disclosure, the sealant 50 is tubular and has openings at its two ends in the movement direction, the movable member 20 includes a first sealing connector 27 extending along an entire periphery of the movable member 20 about the axis in the movement direction, and receiving and sealing an entire periphery of a first opening edge 53 of the sealant 50, and the housing 10 includes a second sealing connector 121 extending along an entire inner peripheral surface defining the compartment 15 about the axis in the movement direction, and receiving and sealing an entire periphery of a second opening edge 51 of the sealant 50.

The switch 1 according to the second aspect allows the gap 52 between the housing 10 and the movable member 20 to be sealed more reliably.

In a switch 1 according to a third aspect of the present disclosure, the movable member 20 is rectangular as viewed in the movement direction, and the guide 30 is located on each of two sides of the movable member 20 in the width direction as viewed in the movement direction.

In the switch 1 according to the third aspect, the guide 30 can have a larger proportion on the outer surface of the movable member 20, and thus guide the movable member 20 in the movement direction more reliably. The switch 1 thus has higher operability.

The embodiments or modifications described above may be combined with one another to produce their advantageous effects. One or more embodiments may be combined with other embodiments, one or more modifications may be combined with other modifications, or one or more embodiments may be combined with one or more modifications. The features of different embodiments or different modifications may also be combined.

Although the present disclosure is fully described in relation to preferable embodiments with reference to the appended drawings, modifications or changes to the present disclosure are apparent to those skilled in the art. Such modifications or changes are intended to fall within the scope of the present disclosure defined by the appended claims unless departing therefrom.

INDUSTRIAL APPLICABILITY

The switch according to the embodiments of the present disclosure may be usable for an automobile.

REFERENCE NUMERALS

1 switch
10 housing
11 case
12 cover
121 sealing cutout
13 operation surface
14 operation hole
15 internal compartment
16 through-hole
20 movable member
21 operation part
22 working surface
23, 24, 25 slope
26 distal end
27 seal groove
30 guide
31 protrusion
32 groove
40 contact mechanism
41 terminal
50 sealant
51 flange
52 gap
61, 62, 63, 64, 65 slope
71, 72, 73 slope
81, 82 slope
CA central axis
CL1, CL2, CL3 center line

The invention claimed is:

1. A switch, comprising:

a housing comprising an operation surface, the operation surface comprising an operation hole and an internal compartment communicating with outside the housing through the operation hole;

a movable member accommodated in the compartment and extending in a movement direction orthogonal to the operation surface from the compartment to outside the housing through the operation hole, the movable member comprising an operation part located at an end of the movable member outside the housing and a seal groove, the movable member being reciprocable in the movement direction relative to the housing;

a guide configured to guide the movable member in the movement direction; and a sealant sealing a gap between the movable member and the housing inside the compartment, the sealant comprising an upper opening and a lower opening, wherein the upper opening of the sealant is received and sealed by the seal groove such that the upper opening of the sealant moves in the movement direction along with the movable member, wherein the operation part comprises a plurality of slopes extending linearly from the operation surface toward a distal end of the movable member outside the housing, and sloping toward a central axis extending in the movement direction of the movable member away from the operation surface, the seal groove extends along an entire periphery of the movable member about the central axis and is located below, in the movement direction, a portion of the moveable member that contacts the housing around an inner periphery of the operation hole and receives and seals an entire periphery of the upper opening of the sealant, and the housing comprises a second seal groove extending along an entire inner peripheral surface defining the compartment about the central axis and receiving and sealing an entire periphery of the lower opening of the sealant.

2. The switch according to claim 1, wherein the movable member is rectangular as viewed in the movement direction, and the guide is located on each of two sides of the movable member in a width direction as viewed in the movement direction.

* * * * *